United States Patent [19]

Prentice et al.

[11] Patent Number: 4,678,126

[45] Date of Patent: Jul. 7, 1987

[54] SHREDDER

[76] Inventors: Charles E. Prentice; Nadine P. Prentice, both of Rte. 3, Box 655, Beaverton, Oreg. 97007

[21] Appl. No.: 794,739

[22] Filed: Nov. 4, 1985

[51] Int. Cl.[4] ..... B02C 18/16

[52] U.S. Cl. ..... 241/34; 241/36; 241/243; 241/292.1

[58] Field of Search ..... 241/36, 37.5, 32, 34, 241/243, 242, 293, 294, 295, 292.1

[56] References Cited

U.S. PATENT DOCUMENTS 2,174,461 9/1939 Fegley et al. ..... 241/243 X 3,545,689 12/1970 Luscombe ..... 241/243 X 3,703,970 11/1972 Benson ..... 241/243 X 4,538,766 9/1985 Vandenbussche ..... 241/243 X

*Primary Examiner*—Mark Rosenbaum

*Attorney, Agent, or Firm*—Kolisch, Hartwell & Dickinson

[57] ABSTRACT

The shredder of the instant invention includes a housing for receiving material to be shred and an arbor carrying plural teeth thereon mounted in the housing. An anvil is provided, having plural grating members, interspersed with the teeth on the arbor, to shred material which is introduced into the housing. The teeth are fixed on the arbor in a helical pattern with each tooth being angularly displaced with respect to the next laterally adjacent tooth.

16 Claims, 3 Drawing Figures

SHREDDER

BACKGROUND AND SUMMARY OF THE INVENTION

This invention relates to shredding machines and particularly to a shredder which is suitable for shredding a variety of materials and does so while operating at a low speed.

Machines for shredding material are well known in the art. Particularly, a machine known as a "hammer hog" is frequently used to reduce the size of waste material prior to disposing of the material, generally by burning as fuel. A hammer hog utilizes a pair of counter rotating shafts having teeth thereon which chew material to a reduced size. Hammer hogs are subject to frequent breakdowns, require a great deal of energy to operate, and are generally very noisy, to the extent that persons in the vicinity of the hammer hog must wear ear protection devices to prevent permanent hearing loss.

An object of the instant invention is to provide a shredder which is energy efficient.

Another object of the instant invention is to provide a shredder which operates at a low operating speed.

A further object of the invention is to provide a shredder which does not produce hazardous sound levels during operation.

Another object of the invention is to provide a shredder which will operate continuously for long periods of time without requiring maintenance.

Another object of the invention is to provide a shredding apparatus which is completely self-contained and which may be easily moved from one location to another.

Yet another object of the instant invention is to provide a shredding apparatus having shredding teeth and a shredding anvil which cooperate to draw material to be shred towards a tooth carrying arbor.

The shredder of the instant invention includes a housing for receiving material to be shred and an arbor carrying plural teeth thereon mounted in the housing. An anvil is provided, having plural grating members, interspersed with the teeth on the arbor, to shred material which is introduced into the housing. The teeth are fixed on the arbor in a helical pattern with each tooth being angularly displaced with respect to the next laterally adjacent tooth.

These and other objects and advantages of the instant invention will become more fully apparent as the description which follows is read in conjunction with the drawings.

DETAILED DESCRIPTION OF A PREFERRED EMBODIMENT

Figure 1:
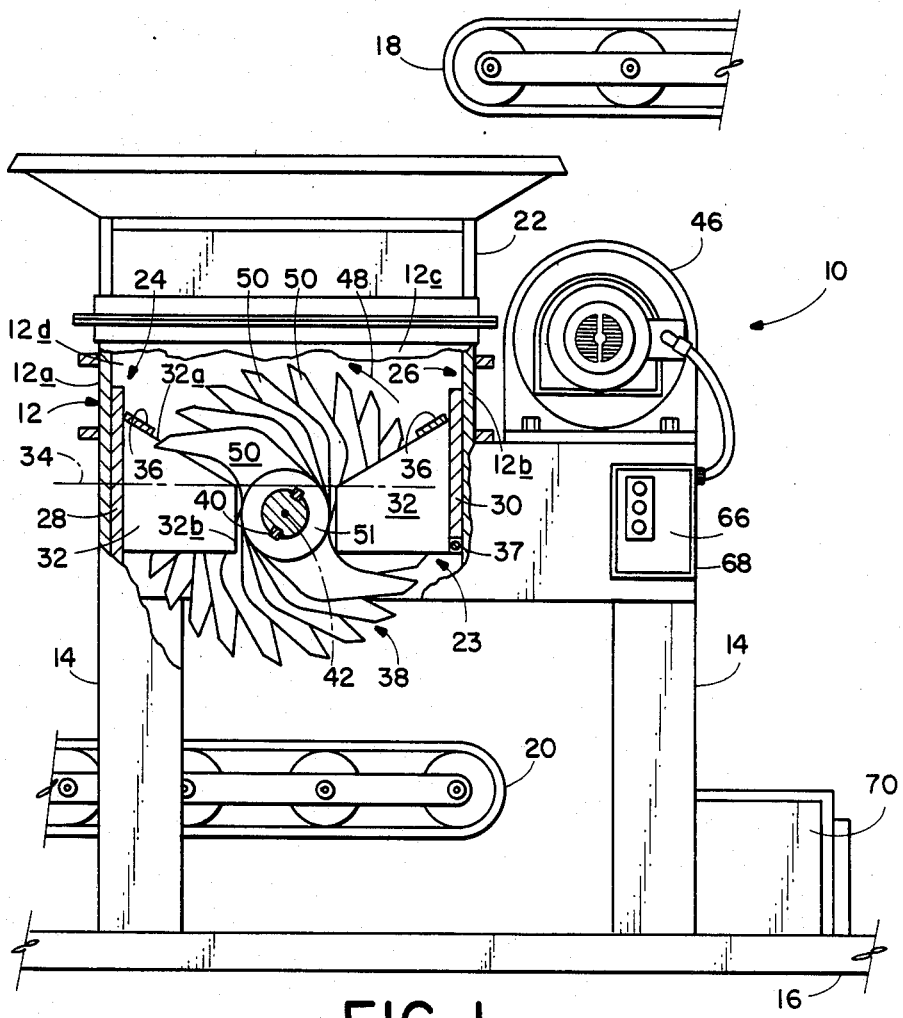
FIG. 1 is a side elevation of the shredder of the instant invention, with portions broken away to show detail.

Turning now to the drawings, and initially to FIG. 1, a shredder constructed according to the instant invention is shown generally at 10. The shredder includes a housing 12 mounted on legs 14 which in turn rest on a platform 16. An infeed or first conveyor 18 provides a flow of material to be shred to the top of housing 12. An output or second conveyor 20 removes material which has been shred from the area underneath housing 12.

Housing 12 is a box-like structure having a pair of spaced apart sides 12*a*, 12*b*, and ends 12*c*, 12*d*. A hopper 22 is mounted above the open top of housing 12.

Figure 2:
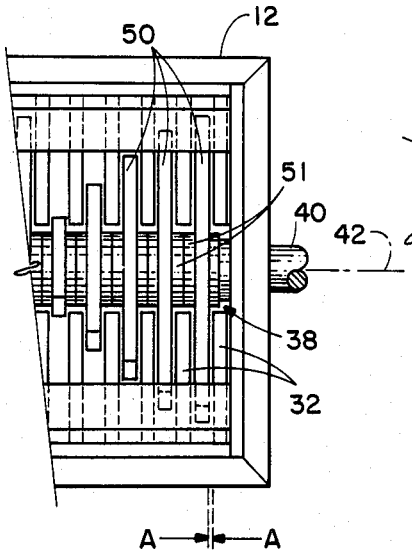
FIG. 2 is top view of a shredder housing of the instant invention.

Mounted on the sides of housing 12 are anvil assemblies 24, 26 which comprise what is referred to herein as anvil means, 23. Referring now to FIGS. 1 and 2, each anvil assembly includes a mounting plate 28, 30 which is secured to the sides 12*a*, 12*b*, respectively. Plural grating members 32 are attached to each mounting plate. Each grating member has a top surface 32*a* which is inclined downward from the side of housing 12 towards the center of the housing. Additionally, each grating member has an upstanding forward edge 32*b* which intersects top surface 32*a*. Top surface 32*a* is inclined at an angle of approximately 30° to a horizontal surface, represented by line 34.

A sliver guard 36 is mounted on each anvil assembly to prevent the passage of material smaller than a predetermined size through housing 12. Assembly 26 may be pivotally mounted on shaft 37.

Arbor means 38 is rotatably mounted in housing 12, medially of housing sides 12*a*, 12*b*. Arbor means 38 includes a single arbor shaft 40 having an axis of rotation 42. Shaft 40 is mounted in housing 12 by bearings (not shown) and is driven by a motor, or power means 46 to produce rotation of arbor shaft 40 in the direction shown by arrow 48.

Arbor shaft 40 has plural tooth bearing bodies, such as those shown at 50, mounted thereon. The bodies are mounted such that they form a helical tooth pattern, where laterally adjacent bodies are angularly displaced, in the preferred embodiment, from the bodies immediately there adjacent by approximately 16.5°. Displacing the bodies by 16.5° insures that two teeth do not simultaneously begin shredding. Displacement of adjacent teeth by an angle of, for instance, 15°, would allow simultaneous commencement of shredding by every twelfth tooth. The tooth bodies and the grating members are arranged such that there is between 1/32-inch and ½-inch clearance between the tooth body and the grating member, as is shown by the dimension A—A in FIG. 2, depending upon the material to be shredded.

Figure 3:
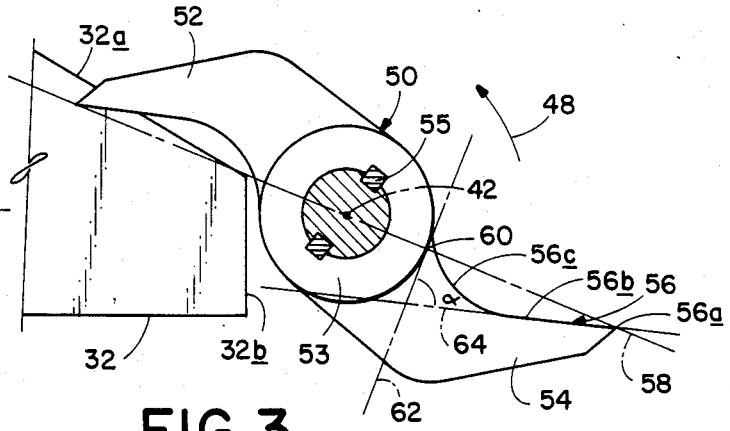
FIG. 3 is an enlarged side view of a tooth body and a grating member constructed according to the invention.

Turning now to FIG. 3, the interaction of a tooth and the grating members is shown. The tooth body 50 includes opposed teeth 52, 54, and a central portion 53. Each tooth, such as tooth 54, has a distal shearing portion 56 which includes a tip 56*a* and a substantially flat stretch 56*b*. Tooth 50 has what may be thought of as a generally curved leading surface which includes tip 56*a*, stretch 56*b* and a curved portion 56*c*. The construction of tooth 54 is such that a line 58 connecting tip 56*a* with the center of the central portion 53 of tooth body 50, which is also the axis of rotation 42 of arbor shaft 40, passes the periphery of central portion 50*c* at a point 60. A tangent 62 may be drawn to the periphery of central portion 53 at point 60. An extension 64 of stretch 56*b* intersects tangent 62 at an angle $\alpha$ of between 70° and 75° (Shown in an exaggerated scale in FIG. 3). In the preferred embodiment, the intersection occurs, with reference to the direction of rotation, as shown by arrow 48, behind point 60. Referring to tooth 52, it can be seen that this arrangement of the leading edge of a tooth, in cooperation with the top surface of the grating members promotes the drawing of material towards the arbor as the material is being shredded.

Tooth bodies, such as tooth body 50, are fixed on arbor shaft 40 by keys 55 (FIG. 3). Spacers 51 (FIG. 2) are provided between individual tooth bodies, and are welded to the tooth bodies, to provide spacing of the tooth bodies along arbor shaft 40. Arbor shaft 40 and spacers 51 comprise what is referred to herein as arbor means 38.

Control means 66 are located in a control box 68. Control means provide suitable circuitry to prevent damage to the shredder should material be encountered which the shredder is unable to breakup. Essentially, the control means provide that, if the shredder teeth stop, motor 46 is reversed for at least one revolution of shaft 40, after which shaft 40 is rotated as shown by arrow 48. If the teeth again stop, motor 46 is again reversed for at least one revolution. Control means are generally set to provide such reversing for up to four cycles, after which motor 46 is shut down and an alarm sounded to alert an operator of a jam in the machine.

Additionally, control means 68 stops infeed conveyor 18 when a jam is first detected so that additional material will not be deposited in hopper 22 until the jam is clear. The unshredded material may be cleared through anvil assembly 26, which may be pivotally mounted and will drop out of the way in order to clear the shredder of a nonshreddable object. Assembly 26 is spring (not shown) biased to the position shown in FIG. 1.

It should be noted, however, that the shredder as disclosed exerts a force of between 5,000 and 9,000 pounds per square inch at the tip of an individual tooth, depending on the horsepower of motor 46. Motor 46 may be provided in variable horsepower ranges. As the nominal use for the shredder is to shred debris such as wood, tires, brush, etc., the shredder is capable of breaking up such material into smaller pieces without jamming or suffering damage. It is generally estimated that a granite rock requires a force of 3,000 pounds per square inch to be broken up, which force is easily produced by a shredder equipped with a relatively small motor.

The motor speed control is adjusted to turn the arbor shaft at between 10 and 50 rpm. At such rpm, the shredder generates sound at between 80 and 90 db when timber slash, containing some embedded rocks, is put through the shredder.

A power supply 70 is provided, and mounted on platform 16 to provide a self-contained shredder unit. Power supply 70 may provide a source of electricity, or a source of electricity and hydraulic power, as required, to drive motor 46, conveyors 18 and 20 and control means 66. Motor 46 and conveyors 18 and 20 may be either electrically or hydraulically powered depending on the desires and needs of the particular operating situation. Platform 16 may be goose-neck or other type of flatbed trailer, which may be moved to a site where waste material to be shred is located.

While a preferred embodiment of the invention has been disclosed, it should be appreciated that variations and modifications thereto may be made without departing from the spirit of the invention.

It is claimed and desired to secure by Letters Patent:

1. A shredder comprising:

a housing for receiving material to be shred;

power means;

arbor means rotatably mounted in said housing and driven by said power means;

anvil means mounted in said housing; said anvil means including grating members, each grating member having a top surface which inclines downwardly toward said arbor means progressing inward from a side of the housing; and plural teeth fixed on said arbor means extending radially outwards therefrom, said teeth being laterally adjacent, angularly displaced with respect to each other to provide a helical tooth pattern extending the length of said arbor means, said teeth being interspersed with said grating members, each tooth having a distal shearing portion having a tip and a substantially flat stretch leading into a concave cutting surface immediately adjacent said arbor means;

said teeth and said grating member being constructed and arranged such that the tip moves past a grating member top surface before portions of the shearing portion located inward from the tip, thus to produce a shearing action forcing matter inward to the arbor means.

2. The shredder of claim 1 wherein said housing is a substantially box-like structure having spaced apart sides and ends and an open top and bottom, and wherein said arbor means has an axis of rotation and extends between said ends substantially medially of said sides.

3. The shredder of claim 1 wherein each of said grating members has an upstanding forward edge proximal to said arbor means, said top surface inclines downwardly to join with said forward edge, said top surface being inclined at an angle of about 30° from horizontal, and the plane of the top surface intersecting the surface of the arbor means at a region which is closer to the top of the arbor surface than the side of the arbor surface.

4. The shredder of claim 1 wherein said anvil means includes sliver guard means to prevent free passage of material larger than a predetermined size through said housing.

5. The shredder of claim 1 wherein laterally adjacent teeth are angularly displaced about 16.5°.

6. The shredder of claim 5 wherein a linear projection of said flat stretch substantially intersects a tangent, subtended from said tip, to said arbor means at an angle of between 70° and 75°.

7. The shredder of claim 1 wherein said plural teeth are arranged in pairs with the teeth of a pair of teeth being diametrically opposed on said arbor means and being formed as part of an integral tooth body.

8. The shredder of claim 1 which further includes control means to detect stoppage of said arbor means when same is rotating in a known direction in a shredding operation, said control means being operable to reverse, for a predetermined period, the direction of rotation, and subsequently operable to cause rotation in said first mentioned direction, said control means causing said directional changes for a predetermined number of cycles.

9. The shredder of claim 1 wherein said arbor means comprises a single rotation arbor which rotates at a predetermined rate of between 10 and 50 rpm.

10. The shredder of claim 1 wherein said teeth and said anvil means are constructed and arranged to promote drawing of material to be shred towards said arbor means.

11. The shredder of claim 1 which further includes first conveyor means to transport material to be shred to said housing and second conveyor means to transport shredded material away from said housing.

12. The shredder of claim 1 which further includes power supply means for providing portable power for the shredder.

13. Shredding apparatus comprising:

a substantially box-like housing having spaced apart sides and ends and an open top and bottom;

arbor means rotatably mounted on said ends substantially medially of said sides;

an anvil assembly adjacent each of said sides extending between said ends, said assemblies having plural grating members mounted on said sides which are spaced apart by a first predetermined distance; wherein each of said members has an upstanding forward edge proximal to said arbor means, a top surface being inclined downwardly from a side of the housing to join with said forward edge, said top surface being inclined at an angle of about 30° from horizontal, and the plane of the top surface intersecting the surface of the arbor means at a region which is closer to the top of the arbor surface than the side of the arbor surface, plural teeth fixed on said arbor means, spaced apart by a second predetermined distance thereon, for interaction with said members to produce shredding of material placed in the top of said housing;

said teeth and said members being spaced to form a clearance of at least 1/32nd of an inch between said teeth and said members;

each tooth having a distal shearing portion having a tip and a substantially flat stretch leading into a concave cutting surface immediately adjacent said arbor means;

said teeth and said grating member being constructed and arranged such that the tip moves past a grating member top surface before portions of the shearing portion located inward from the tip, thus to produce a shearing action forcing matter inward to the arbor means; and power means operable to rotate said arbor.

14. The apparatus of claim 13 wherein said teeth are arranged on said arbor means such that each tooth is angularly displaced from that of the next adjacent tooth by an angle of about 16.5°, thereby forming a helical pattern of teeth on said arbor means.

15. The apparatus of claim 13 which further includes control means to control the direction of rotation of said arbor means, said control means being operable to detect stoppage of said arbor means and to reverse, for a predetermined period, the direction of arbor rotation, thereby carrying nonshreddable material in a reverse direction through said pivotally mounted assembly, thereby discharging same through the bottom of said housing.

16. The shredder of claim 15 which further includes first conveyor means to transport material to be shred to said housing and second conveyor means to transport shredded material away from said housing wherein said control means is operable to stop said first conveyor means upon detection of stop page of said arbor and during reverse rotation of said arbor.

* * * * *